US012578088B2

(12) United States Patent
Yan et al.

(10) Patent No.: US 12,578,088 B2
(45) Date of Patent: Mar. 17, 2026

(54) BURNER, BURNER MODULE COMPRISING SAME AND HEATING DEVICE

(71) Applicant: L'Air Liquide, Société Anonyme pour l'Etude et l'Exploitation des Procédés Georges Claude, Paris (FR)

(72) Inventors: Tao Yan, Shangahi (CN); Remi Tsiava, Saint Germain-les-Corbeil (FR); Peter Vankampen, Shanghai (CN); Yuquan Gu, Shanghai (CN)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 387 days.

(21) Appl. No.: 18/080,454

(22) Filed: Dec. 13, 2022

(65) Prior Publication Data

US 2023/0213183 A1 Jul. 6, 2023

(30) Foreign Application Priority Data

Dec. 30, 2021 (CN) ..... 202111649496.1

(51) Int. Cl.
*F23D 14/02* (2006.01)
*F23D 14/78* (2006.01)

(52) U.S. Cl.
CPC ..... *F23D 14/02* (2013.01); *F23D 14/78* (2013.01)

(58) Field of Classification Search
CPC ..... F23D 11/102; F23D 11/103; F23D 14/02; F23D 14/78
USPC ..... 431/354, 157–158
See application file for complete search history.

(56) References Cited

U.S. PATENT DOCUMENTS 4,195,779 A * 4/1980 Auclair ..... F23D 11/102 239/8
5,143,297 A * 9/1992 De Michele ..... B05B 7/0892 239/433
2016/0060154 A1* 3/2016 Cowles ..... F23C 3/004 65/356
2018/0065877 A1 3/2018 Faulkinbury

FOREIGN PATENT DOCUMENTS

| | | |
|---|---|---|
| EP | 0 117 472 | 9/1984 |
| EP | 1 607 370 | 12/2005 |
| GB | 261 808 | 12/1926 |
| MX | 2015 000 160 | 4/2015 |

OTHER PUBLICATIONS

EP Search Report for EP 22 21 4296, mailed May 23, 2023.

* cited by examiner

*Primary Examiner* — Vivek K Shirsat
(74) *Attorney, Agent, or Firm* — Allen E. White

(57) ABSTRACT

The present invention relates to a burner. At least one first passage, at least one second passage and a mixing chamber are formed in the burner, and the mixing chamber is respectively connected to an outlet of the first passage and an outlet of the second passage, so that a first fluid and a second fluid are mixed in the mixing chamber to form a fluid mixture; wherein the burner includes a nozzle, and at least one through passage fluidly connected to the mixing chamber is formed in the nozzle, so that the fluid mixture flows out from the at least one through passage, and wherein the sum of the sectional areas of the at least one through passage is smaller than the sectional area of the mixing chamber.

13 Claims, 7 Drawing Sheets

BURNER, BURNER MODULE COMPRISING SAME AND HEATING DEVICE

CROSS REFERENCE TO RELATED APPLICATIONS

This application claims the benefit of priority under 35 U.S.C. § 119 (a) and (b) to Chinese Patent Application No. 202111649496.1, filed Dec. 30, 2021, the entire contents of which are incorporated herein by reference.

TECHNICAL FIELD

The present invention relates to a burner, a burner assembly or burner module comprising the burner, and a heating device provided with the burner.

BACKGROUND $CO_2$ emission has become a common concern in the international community. This is one of the most important topics in society today. People are making efforts to seek solutions for reducing $CO_2$ emission. One of the main directions is to reduce $CO_2$ emission by reducing energy consumption and increasing energy utilisation rate.

A burner is an apparatus that converts an oxidant and a fuel into heat by a chemical reaction of combustion. A burner is provided in a heating device (for example, a furnace) to heat a heated medium therein. Conventional heating methods adopt flame radiation heating or indirect heating (with the heat of flame combustion transferred to the heated medium through a heat transfer medium), which has the characteristics of high heat loss, low thermal efficiency and high energy consumption.

In the prior art, submerged combustion is also used for heating, wherein a submerged burner is located under the surface of the heated medium. Submerged burners may be installed on the side wall and/or bottom of a furnace or other heating devices, and some may also be installed at the top with the nozzles immersed in the melt of the heated medium. For a submerged burner, the flame and combustion products of the fuel and the oxidant pass through and come into direct contact with the heated medium. The heat transfer effect is thus much more efficient than that of the flame radiant heat transfer over the heated medium, and heat transfer to the refractory material in the furnace and heat loss in the flue gas are reduced, which can lower fuel consumption and thus carbon dioxide emission. In addition, NOx emissions are also reduced during the combustion process due to the lower temperature above the heated medium in the combustion chamber. Further, the combustion products of a high flow rate generated by the oxidant and the fuel enter the heated medium, and the gas expands during the submerged combustion process, thereby the heated medium is rapidly heated up or melted and generates a large amount of turbulence. It is easier to mix the heated medium evenly, which can eliminate the need for a mechanical stirrer in the prior art, and the heat transfer effect inside the heated medium is better. Moreover, submerged burners have a smaller size, higher production efficiency and lower installation costs than conventional burners that are provided above the heated medium.

However, for submerged burners, there are still various problems that need to be solved. For example, since the nozzles of the burner are immersed in the melt of the heated medium, the fluctuation of the melt can easily cut off the flame of the burner, which can easily lead to flame-out of the burner. Especially when the temperature of the melt of the heated medium is low, the burner will flame out more easily. By way of further example, achieving a more stable flame of a submerged burner, preventing the risk of explosion, improving the combustion performance when hydrogen is used as the fuel, improving the heat transfer efficiency, preventing clogging of the nozzles by the heated medium, and reducing ablation of the burner are issues requiring continuous attention during the design of submerged burners. In addition, most parts of a submerged burner are positioned in the heated medium, and thus are not easy to maintain or replace, and it is not easy to know the working status of the burner, for example, whether it is working normally or has flamed out.

Moreover, in existing submerged burners, in order to prevent ablation and damage to the burner nozzles caused by the high temperature of the flame, the burner is usually cooled by a circulating cooling medium while burning. By using a circulating cooling medium, a large amount of heat is removed, resulting in increased energy consumption, and the use of cooling devices, for example, cooling jackets, increases the cost and complexity of the burner structure.

The purpose of the present invention is to overcome at least one aspect of the above problems, shortcomings and other technical problems in the prior art.

SUMMARY

In a first solution of the present invention, a burner is provided, in which at least one first passage, at least one second passage and a mixing chamber are formed, wherein an inlet of each first passage is fluidly connected to a supply port of a first fluid, an inlet of each second passage is fluidly connected to a supply port of a second fluid, and the mixing chamber is respectively fluidly connected to an outlet of the first passage and an outlet of the second passage, so that the first fluid and the second fluid are mixed in the mixing chamber to form a fluid mixture, wherein the burner comprises a nozzle, with at least one through passage fluidly connected to the mixing chamber formed therein, so that the fluid mixture flows out from the at least one through passage, and wherein the sum of the sectional areas of the at least one through passage is smaller than the sectional area of the mixing chamber.

In a second solution of the present invention, the burner according to the first solution is disclosed, wherein the sum of the sectional areas of all the through passages is 5-90%, preferably 20-60%, of the sectional area of the mixing chamber.

In a third solution of the present invention, the burner according to the first or second solution is disclosed, wherein none of the through passages in the nozzle is on the same axis as the second passage; or the at least one through passage includes a through passage on the same axis as the second passage, wherein the equivalent diameter of the through passage on the same axis as the second passage is smaller than 50% of the equivalent diameter of the outlet of the second passage.

In a fourth solution of the present invention, a burner according to the third solution is disclosed, wherein one second passage is formed, which is essentially located at the centre in the radial direction of the burner.

In a fifth solution of the present invention, the burner according to any of the first to the fourth solutions is disclosed, wherein a plurality of through passages are provided in the nozzle, and the through passages include inner passages and outer passages, wherein an outer outlet of each outer passage is located outside an inner outlet of each inner passage in the radial direction of the nozzle, preferably, the inner outlet has a smaller aperture than the outer outlet.

In a sixth solution of the present invention, the burner according to the fifth solution is disclosed, wherein the through passages extend in a direction gradually away from an axis of the nozzle from their inlets to their outlets.

In a seventh solution of the present invention, the burner according to the fifth or sixth solution is disclosed, wherein the outer outlets are evenly distributed on one circumference, and/or the inner outlets are evenly distributed on one circumference.

In an eighth solution of the present invention, the burner according to the seventh solution is disclosed, wherein the inner outlets are spaced apart from the outer outlets in the circumferential direction; preferably, each inner outlet is located in the middle between two outer outlets adjacent to it in the circumferential direction.

In a ninth solution of the present invention, the burner according to any of the first to the eighth solutions is disclosed, wherein the outlet of the at least one through passage is configured such that a propagation speed of a flame is smaller than a flow rate of a mixture at the outlet of the through passage.

In a tenth solution of the present invention, the burner according to any of the first to the ninth solutions is disclosed, wherein the flow rate of the first fluid at the outlet of the first passage and the flow rate of the second fluid at the outlet of the second passage are both greater than the flow rate of the mixture at the outlet of the through passage; preferably, the flow rate of the second fluid at the outlet of the second passage is greater than that of the first fluid at the outlet of the first passage.

In an eleventh solution of the present invention, the burner according to any of the first to the tenth solutions is disclosed, wherein the sectional area of the mixing chamber is 20-90%, preferably 40-60%, of the sectional area of the outer contour of the nozzle.

In a twelfth solution of the present invention, the burner according to any of the first to the tenth solutions is disclosed, wherein the volume of the mixing chamber is no more than 500 ml, and is preferably 5-50 ml; preferably, the length of the mixing chamber in the flow direction of the fluid mixture is 0.5-20 times, preferably 1-5 times, the equivalent inner diameter of the mixing chamber.

In a thirteenth solution of the present invention, the burner according to any of the first to the twelfth solutions is disclosed, wherein the burner is used to heat the following material to be heated: wherein the temperature of a melt of the material to be heated is lower than an autoignition temperature of the mixed fluid, and/or the temperature of a melt of the material to be heated is lower than the maximum temperature that the nozzle can withstand.

In a fourteenth solution of the present invention, the burner according to the thirteenth solution is disclosed, wherein the material to be heated is a metal with a low melting point, for example, zinc, lead or aluminium, in which case, the power range of the burner is 10 KW-1 MW, wherein the volume of the mixing chamber is 5-200 ml, and the length of the mixing chamber in the flow direction of the fluid mixture is 0.5-10 times the equivalent inner diameter of the mixing chamber; or wherein the material to be heated is water, in which case, the power range of the burner is 5 KW-0.5 MW, wherein the volume of the mixing chamber is 5-150 ml, and the length of the mixing chamber in the flow direction of the fluid mixture is 1-5 times the equivalent inner diameter of the mixing chamber.

In a fifteenth solution of the present invention, the burner according to any of the first to the fourteenth solutions is disclosed, wherein the at least one first passage is configured to cause the first fluid to produce rotational flow in a first rotation direction; and/or the at least one second passage is configured to cause the second fluid to produce rotational flow in a second rotation direction, preferably, the first rotation direction is opposite to the second rotation direction.

In a sixteenth solution of the present invention, the burner according to the fifteenth solution is disclosed, wherein a helical groove with the helical direction being the first rotation direction is formed in at least a part of the at least one first passage, and/or a helical groove with the helical direction being the second rotation direction is formed in at least a part of the at least one second passage.

In a seventeenth solution of the present invention, the burner according to the fifteenth or the sixteenth solution is disclosed, wherein the at least one first passage is a plurality of first passages, wherein the outlet of each of the first passages is located at a different position in the circumferential direction relative to the inlet thereof, so that flows of the first fluid from the plurality of first passages form a rotational flow in the first rotation direction as a whole in the mixing chamber.

In an eighteenth solution of the present invention, the burner according to the fifteenth or the sixteenth solution is disclosed, wherein the at least one first passage is a plurality of first passages, each of the first passages comprises:

a first part, extending parallel to an axis of the burner from the inlet of the first passage; and a second part, an outlet of which is located at a different position in the circumferential direction relative to an inlet thereof, so that flows of the first fluid from the plurality of first passages form a rotational flow in the first rotation direction as a whole in the mixing chamber.

In a nineteenth solution of the present invention, the burner according to the fifteenth or the sixteenth solution is disclosed, wherein the at least one first passage is a plurality of first passages, each of the first passages comprises:

a first part, extending parallel to an axis of the burner from the inlet of the first passage; and a second part, extending obliquely toward an axis of the burner from the first part to the outlet of the first passage.

In a twentieth solution of the present invention, the burner according to the first to the nineteenth solutions is disclosed, wherein the burner further comprises an igniter extending into the mixing chamber.

In a twenty-first solution of the present invention, the burner according to the twentieth solution is disclosed, wherein the burner further comprises an intelligent ignition system, wherein the ignition system comprises a sensor and a controller used for monitoring a flame status in the burner, and the controller is configured to control the igniter to fire when the sensor senses that flame in the burner is extinguished.

In a twenty-second solution of the present invention, the burner according to the twenty-first solution is disclosed, wherein the sensor comprises: a monitor for monitoring the flame in the mixing chamber, for example, an ultraviolet monitor; and/or a temperature sensor for measuring a temperature in the burner.

In a twenty-third solution of the present invention, the burner according to the first to the twenty-second solutions is disclosed, wherein the burner comprises:

a first fluid guide, wherein the at least one first passage is formed in the first fluid guide; and a second fluid guide, wherein the at least one second passage is formed in the second fluid guide;

wherein the mixing chamber is formed between the first fluid guide and/or the second fluid guide on the one hand and the nozzle on the other.

In a twenty-fourth solution of the present invention, the burner according to the twenty-third solution is disclosed, wherein the first fluid guide is at least partially disposed in the nozzle, with a through hole formed in the first fluid guide, and the second fluid guide is at least partially disposed in the through hole.

In a twenty-fifth solution of the present invention, the burner according to the twenty-third or the twenty-fourth solution is disclosed, wherein the burner further comprises an independent main body, the nozzle is connected to the main body, and the nozzle, the first fluid guide, and the second fluid guide are all separate components.

In a twenty-sixth solution of the present invention, the burner according to the twenty-fifth solution is disclosed, wherein a first step portion and a second step portion are formed in the nozzle, wherein an end face of the first fluid guide abuts the first step portion, and the main body comprises a connecting portion that abuts the second step portion.

In a twenty-seventh solution of the present invention, the burner according to any of the first to the twenty-fourth solutions is disclosed, wherein the nozzle and the main body of the burner are formed as an integral piece, a first cooling medium channel is integrated in the integral piece, and preferably the first cooling medium channel extends to the through passage of the nozzle.

In a twenty-eighth solution of the present invention, the burner according to any of the twelfth to the twenty-seventh solutions is disclosed, wherein the range of the equivalent diameter of the outlet of each of the through passages is 0.3 mm-10 mm, preferably 0.8 mm-6 mm, and more preferably 1 mm-5 mm.

In a twenty-ninth solution of the present invention, the burner according to any of the first to the twenty-eighth solutions is disclosed, wherein either the first fluid or the second fluid is an oxidant, and the other is a fuel, preferably hydrogen.

In a thirtieth solution of the present invention, the burner according to any of the first to the twenty-ninth solutions is disclosed, wherein the burner is a submerged burner.

In a thirty-first solution of the present invention, a burner assembly is disclosed, which comprises the burner according to any of the first to the thirtieth technical solutions, and a cooling jacket provided outside the burner, with a second cooling medium channel formed in the cooling jacket.

In a thirty-second solution of the present invention, a burner assembly according to the thirty-first solution is disclosed, wherein a nozzle of the burner comprises a step portion on the outside thereof, and the cooling jacket comprises a radially inward protrusion, wherein the protrusion is fitted on the step portion; preferably, the burner further comprises a sealing gasket disposed between the protrusion and the step portion.

In a thirty-third solution of the present invention, a burner module is disclosed, which comprises:

a plurality of burners according to any of the first to the thirtieth technical solutions or burner assemblies according to either of the thirty-first and the thirty-second technical solutions; and a common cooling block, with a plurality of installation spaces defined therein, wherein each of the burners or burner assemblies is installed in a corresponding one of the installation spaces.

In a thirty-fourth solution of the present invention, the burner module according to the thirty-third solution is disclosed, wherein the common cooling block is composed of a first part and a second part that are independent of each other, the first part and the second part together define the installation spaces, and preferably a flow direction of a cooling medium in the first part is opposite to that of the cooling medium in the second part.

In a thirty-fifth solution of the present invention, a burner module is disclosed, which comprises:

a plurality of burners according to any of the first to the thirtieth technical solutions;

a first fluid supply pipeline capable of supplying the first fluid to each burner; and a second fluid supply pipeline capable of supplying the second fluid to each burner.

In a thirty-sixth solution of the present invention, a burner module is disclosed, which comprises:

a plurality of burner assemblies according to either of the thirty-first and the thirty-second solutions;

a first fluid supply pipeline capable of supplying the first fluid to each burner assembly; a second fluid supply pipeline capable of supplying the second fluid to each burner assembly; and a cooling medium loop capable of supplying a cooling medium to each burner assembly.

In a thirty-seventh solution of the present invention, a heating device is disclosed, wherein a heated medium is accommodated in the heating device, and the heating device comprises the burner according to any of the first to the thirtieth technical solutions, or the burner assembly according to either of the thirty-first and the thirty-second solutions, or the burner module according to any of the thirty-third to the thirty-sixth technical solutions.

The burners of various structures of the present invention have at least the following benefits:

Since the total sectional area of the through passages formed in the nozzle is smaller than the sectional area of the mixing chamber, the downstream flow of the fluid mixture in the mixing chamber is blocked by the nozzle, and the local flow rate of at least a part of the stream of the fluid mixture will be smaller than the propagation speed of the flame produced by the combustion of the fluid mixture. Therefore, the flame can remain in the mixing chamber, which is equivalent to retaining the combustion source in the burner, and the combustion can still continue even if the flame outside the burner nozzle is cut off. Thus, the burner cannot easily flame out.

Since the burner of the present invention can effectively prevent the flame from extinguishing, it is especially effective when used as a submerged burner, in case that the fluidity of the melt of the heated medium is high, or the temperature of the melt of the heated medium therein is low, for example, lower than the autoignition temperature of the fluid mixture, or the temperature of the melt of the heated medium is lower than the maximum temperature that the nozzle can withstand. This in turn gives rise to many advantages. For example, the melt can be used directly as a cooling medium to cool the burner nozzle immersed therein or the burner itself, thereby eliminating the need for a separate cooling device for the burner. In addition, the energy utilization rate is higher, the structure of the burner is simpler, the cost is lower, and maintenance is easier.

Premixing by forming a mixing chamber improves flame stability, while the limited mixing space of the mixing chamber prevents the accumulation of excess mixed gas and reduces the risk of explosion. The burner of the present invention has higher flame stability, higher heat transfer efficiency and a lower risk of explosion, especially when hydrogen is used as the fuel.

By designing the flow path such that the fuel and/or the oxidant produces a rotational flow for mixing, the mixing of the two can be made faster, more fully and uniformly, so as to achieve a more stable combustion flame and combustion performance. By forming rotational flows of the first fluid and the second fluid in opposite rotation directions, the two fluids collide to achieve a strong mixing effect.

By providing a plurality of through passages in the nozzle, the area of the flame is increased in general. Since the aperture of the outlet of each through passage is small, the flame is shorter and thus more stable and not easy to extinguish, and the setting of the outlet aperture prevents the through passages of the nozzle from being blocked. Further, the design of the inner outlet with a small aperture makes the flame less easy to extinguish.

The provided burner module and burner combinations allow the flexibility to meet the requirements of a variety of power ranges, and can reduce costs, create more compact structures to save space, and provide even cooling.

The monitoring and maintenance of the burner is more convenient and less expensive as a monitoring system is provided. The modular design of the burner components also makes replacement and maintenance easier.

BRIEF DESCRIPTION OF THE FIGURES

The features and advantages of embodiments of the present invention will be better understood with reference to the following description and accompanying drawings, wherein.

DETAILED DESCRIPTION OF THE PREFERRED EMBODIMENTS

Figure 1:
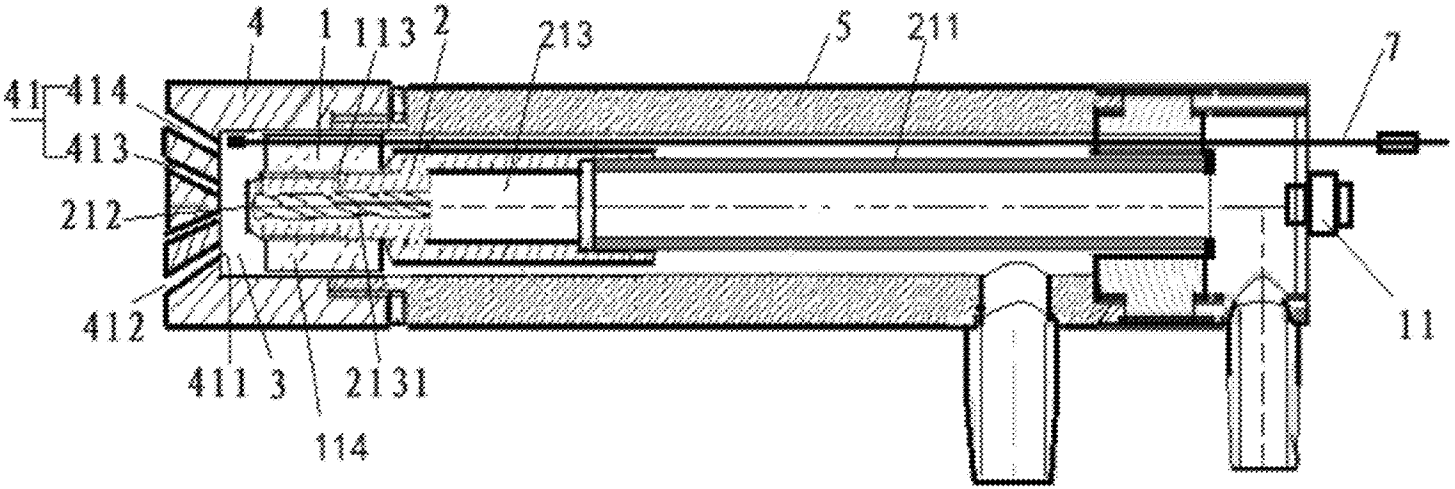
FIG. 1 is a schematic profile view of the burner according to a first exemplary embodiment of the present invention.

The technical solutions of the present invention will be further described in detail below through the embodiments and in conjunction with the accompanying drawings. The following description of the embodiments of the present invention with reference to the drawings is intended to explain the general concept of the present invention, and should not be understood as a limitation on the present invention.

In addition, in the following detailed description, for convenience of explanation, numerous specific details are set forth in order to provide a thorough understanding of the embodiments. Obviously, however, one or more embodiments may be implemented without these specific details. In other cases, commonly-known structures and devices are not shown as graphical representations to simplify the drawings.

In the description of the present application, the terms "first" and "second" are used only for descriptive purposes, and should not be understood as indicating or implying relative importance or implicitly indicating the number of technical features indicated. Hence, a feature defined with "first" and "second" may explicitly or implicitly include one or a plurality of the feature. In the description of the present invention, "a plurality" means two or more than two, unless otherwise clearly specified.

In the present invention, unless otherwise clearly specified and defined, terms such as "installed", "connected with", "connected to", "fixed", etc. should be understood in a broad sense. For example, it can be a fixed connection or a detachable connection, or integrated; it can be a mechanical connection or an electrical connection; it can be directly connected or indirectly connected through an intermediate medium, which can be the internal connection between two components or the interaction between two components. Those skilled in the art can understand the specific meaning of the above terms in the present invention according to the specific circumstances.

As used herein, the term "fuel" refers to a gaseous fuel, a liquid fuel or a solid fuel that can be used interchangeably or in combination with each other. If it is at least partially in the gaseous form, it can be introduced directly into the burner. If it is in the liquid or the solid form, it is introduced in the vicinity of the burner. Gaseous fuels may be natural gas (mainly methane), propane, hydrogen, syngas, biomass gas or any other hydrocarbon and/or compound containing sulphur and/or nitrogen. The solid or liquid fuel may mainly be any compound in a carbon-containing and/or hydrocarbon and/or sulphur-containing form. Those skilled in the art can decide the way in which the gaseous, liquid or solid fuel is introduced as required; it is not the intention of the present invention to impose any limitations in this regard.

As used herein, the term "nozzle" refers to a component positioned at an end of the burner that ejects fuel and oxidant, or a mixture thereof, which may be a separate component, a part of another component, or a component composed of a plurality of parts.

As used herein, the term "melt of the heated medium" may refer either to a liquid substance or solid-liquid mixture obtained after melting various solid substances, or to a solid substance for melting into a liquid substance that is not yet molten, for example, molten metal, molten resin, molten glass or molten solid waste substance, etc., and may also refer to a heated medium that is liquid before being heated, which is heated here with its temperature raised, for example, water. The "temperature of the melt of the heated medium" referred to herein means the desired temperature of the heated medium when it is heated by the heating device or the equilibrium temperature at which the heated medium reaches a temperature equilibrium during the operation of the heating device, the desired temperature or equilibrium temperature being, for example, a certain temperature of the heated medium in the solid-liquid mixture state, or in a completely liquid state before reaching the boiling point, or before being transformed into a gas, or at the boiling point but not completely transformed into a gas.

As used herein, the terms "fusion", "melting", "melting operation", and "melting process" include an operation of heating a heated medium from an essentially solid state to an essentially liquid state.

As used herein, the term "equivalent diameter" refers to the diameter of a circle that is equal to the sectional area of a profile or outer profile.

As used herein, the term "axial" refers to a direction of an axis of rotation, an axis of symmetry, or an approximate centreline that is essentially parallel to the direction of the central axis of the burner. The term "radial" may refer to a direction or relationship relative to a line extending perpendicularly outward from a shared centreline, axis, or similar reference. For example, two concentric and axially overlapping cylindrical parts may be considered to be "radially" aligned in the axially overlapping portions of these parts, but not "radially" aligned in the portions of these parts not axially overlapping. In some cases, these parts may be considered to be "radially" aligned even though one or both of them may not be cylindrical (or otherwise radially symmetric).

As used herein, "flow rate" means the volume of "the first fluid, "the second fluid", "the fluid mixture", or "the mixture" referred to herein flowing through a unit cross section in the passage/channel or at an outlet per unit time, which may be expressed as the flow rate $v=V/(T*S)$, where V represents the volume of the fluid, T represents time, and S represents the sectional area of the passage/channel or at the outlet, in units of m/s for example.

The present invention provides a burner. As shown in FIGS. 1 to 3 and 10, at least one first passage 114, at least one second passage 213 and a mixing chamber 3 are formed in the burner, an inlet 111 of each first passage is fluidly connected to a supply port of a first fluid, an inlet of each second passage 213 is fluidly connected to a supply port of a second fluid; the mixing chamber 3 is respectively fluidly connected to an outlet 112 of the first passage and an outlet 212 of the second passage, so that the first fluid and the second fluid are mixed in the mixing chamber 3 to form a fluid mixture, wherein the burner comprises a nozzle 4, the mixing chamber 3 is at least partially formed in the nozzle 4, and at least one through passage 41 fluidly connected to the mixing chamber is formed in the nozzle 4, so that the fluid mixture flows out from the at least one through passage 41, wherein the sum of the sectional areas of the at least one through passage is smaller than the sectional area of the mixing chamber 3.

In this example, since the total sectional area of the through passages formed in the nozzle 4 is smaller than the sectional area of the mixing chamber 3, the downstream flow of the fluid mixture in the mixing chamber is blocked by the nozzle, and, when the fluid mixture collides with the body of the nozzle, the local flow rate of at least a part of the stream will be smaller than the propagation speed of the flame produced by the combustion of the fluid mixture. Therefore, the flame can remain in the mixing chamber 3. It is equivalent to retaining the combustion source in the burner, and the combustion can still continue even if the flame outside the burner nozzle is cut off. Thus, the burner cannot easily flame out.

The sum of the sectional areas of all the through passages may be set to 5-90%, preferably 20-60%, of the sectional area of the mixing chamber 3. Experiments have shown that the design of the through passages in the nozzle allows the fluid to sufficiently ensure that the flame stays in the mixing chamber and that the burner does not flame out.

Figure 2:
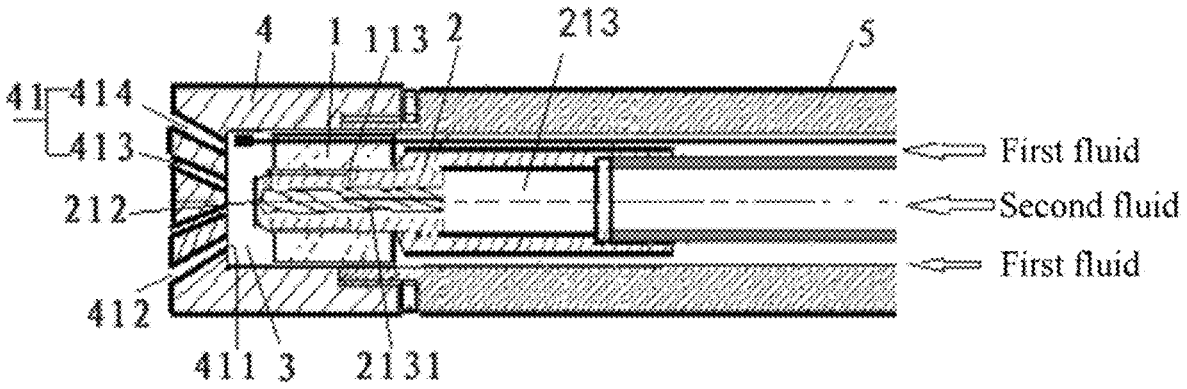
FIG. 2 is a partial enlarged schematic detail view of the end of the burner in FIG. 1.
Figure 3:
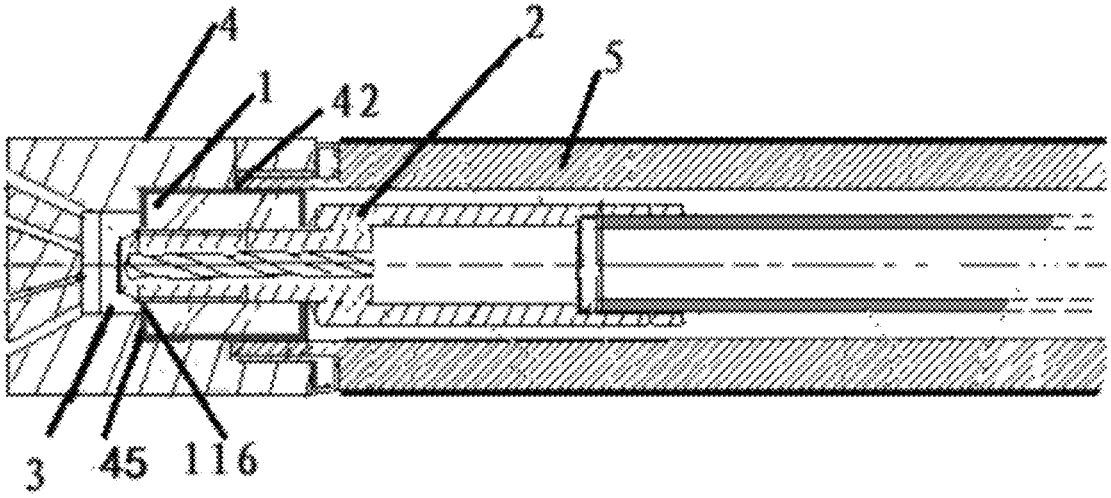
FIG. 3 is a partial schematic detail view of the burner according to a second exemplary embodiment of the present invention.
Figure 4:
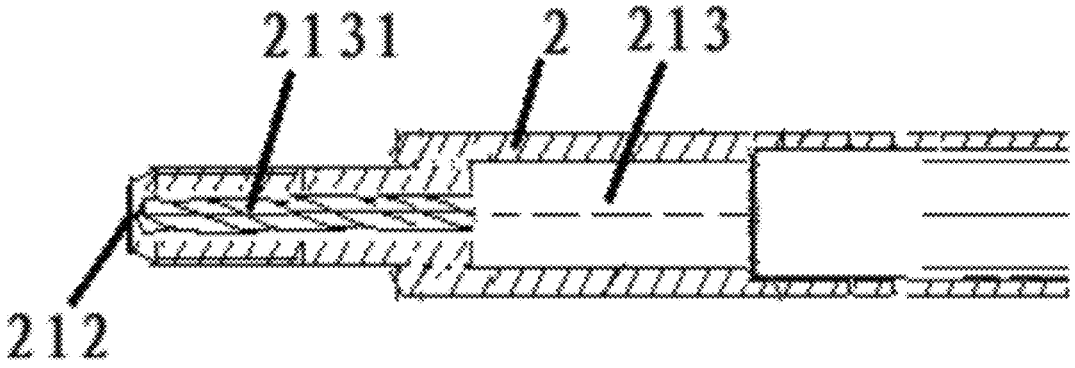
FIG. 4 is a schematic profile view of an exemplary second fluid guide.
Figure 10:
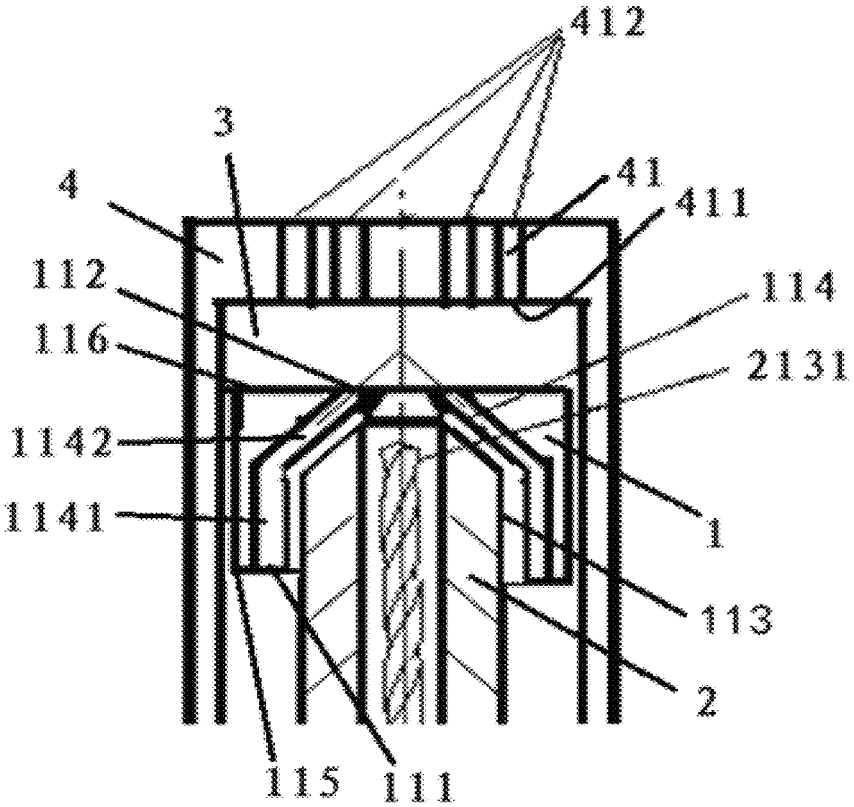
FIG. 10 is a schematic diagram of the burner according to a third exemplary embodiment of the present invention.
Figure 11:
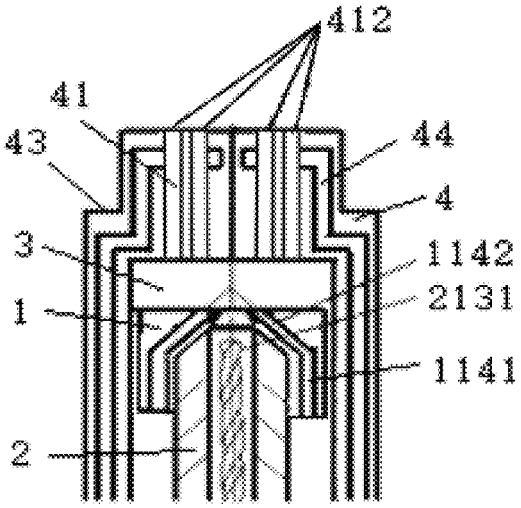
FIG. 11 is a schematic diagram of the burner according to a fourth exemplary embodiment of the present invention.

Preferably, in the first and the second embodiments shown in FIGS. 1 to 3 and the third and the fourth embodiments shown in FIGS. 10 and 11, none of the through passages in the nozzle 4 is located on the same axis as the second passage 213. In other words, it can be seen from FIGS. 1 to 3, 10 and 11 that no through passage is provided at the position of the nozzle 4 facing the outlet 212 of the second passage 213. In these embodiments, one second passage 213 is formed, and is located essentially at the centre of the burner in the radial direction, in which case, "none of the through passages in the nozzle 4 is on the same axis as the second passage 213" means that no through passage is provided at the central position of the nozzle, where it is solid (by analogy, those skilled in the art can understand the scenarios where there are a plurality of second passages or the second passage is located at other positions). Therefore, a part (even most) of the second fluid from the second passage 213 flows downstream and is blocked at the position of the nozzle 4 opposite to the outlet 212 of the second passage, and the blocked part is reversed, so that it is possible to form more of a local stream as follows in the mixing chamber: a local stream with the local flow rate smaller than the propagation speed of the flame produced by the combustion of the fluid mixture, thereby more flame can be retained in the mixing chamber 3 more sufficiently, thus ensuring that the flame does not extinguish.

Alternatively, the at least one through passage may include a through passage on the same axis as the second passage 213, in which case a part of the second fluid from the second passage 213 will also be blocked by the through passage as long as the diameter of the through passage on the same axis as the second passage 213 is sufficiently small, for example, when its equivalent diameter is smaller than 50% of the equivalent diameter of the outlet of the second passage, thereby retaining more flame in the mixing chamber 3 more sufficiently and ensuring that the flame does not extinguish as described above.

In the description herein, one of the first fluid and the second fluid is an oxidant, and the other is a fuel. In the following description, the first fluid is an oxidant and the second fluid is a fuel for illustration. However, those skilled in the art can also understand that the illustrated second passage 213 may also supply the fuel and the first passage 114 may be used to supply the oxidant.

It should be noted that a submerged burner is used in most cases to describe the structure and advantages of the present invention herein, but this does not mean that the burner of the present invention is limited to being used as a submerged burner. As mentioned above, the burner of the present invention can also be used as other kinds of burners, all of which have the advantage that the flame does not easily extinguish.

It has been found in research and practice that, when the fluidity of the melt formed by the heated medium of a submerged burner is high, the fluctuation of the melt easily leads to cut-off of the flame outside the burner; in a melt environment where the temperature of the melt in which the burner is positioned is lower than the autoignition temperatures of the fuel and the oxidant, the flame also easily extinguishes, and autoignition cannot be achieved. With the exemplary structure of the present invention, the flame can be partially retained in the mixing chamber 3, which is equivalent to retaining the combustion source in the burner, and therefore the combustion can still continue even if the flame outside the burner nozzle is cut off.

Since the submerged burner of the present invention can effectively prevent the extinction of the flame, it is particularly effective in the above-mentioned scenario. This in turn gives rise to many advantages. For example, the melt at a relatively low temperature can be used directly as a cooling medium to cool the burner nozzle immersed therein or the burner itself, to lower the temperature of the burner nozzle to below the temperature it can withstand or lower, thereby eliminating the need of a separate cooling device for the burner. Moreover, in the cooling process, the heat of the burner is transferred to the heated medium through heat exchange to heat it, and the energy utilization rate is higher. The loss of heat carried away by the cooling medium when the burner is cooled by an additional cooling device in the prior art is reduced, and the burner features a simpler structure, lower cost and easier maintenance. The burner nozzle is cooled to a safe range by the heated medium to ensure its service life and the safe operation of the equipment.

As an example of a heated medium, the submerged burner of the present invention may be used, for example, in existing hot water baths in the chemical industry. The heated medium may also be a substance with a low melting point, for example, a metal or alloy with a low melting point, such as zinc, lead or aluminium. In the present invention, "a low melting point" is a relative concept, which means that the temperature of the heated medium or the melt of the heated medium is lower than the autoignition temperature of the fluid mixture, and/or the temperature of the heated medium or the melt of the heated medium is lower than the maximum temperature that the burner nozzle can withstand. As mentioned above, in the case where the temperature of the melt is lower than the maximum temperature that the nozzle can withstand, the nozzle can be cooled by the melt.

The autoignition temperatures of various fuels with air or oxygen as the oxidant are shown in Table 1 below. When the temperature of the melt of the heated medium is lower than the autoignition temperatures of the corresponding fuel and oxidant, the submerged burner of the present invention can be used in particular to heat it to achieve the effects described above. Or, when the temperature of the melt of the heated medium is lower than the maximum temperature that the nozzle can withstand, the submerged burner of the present invention can also be used in particular to heat it to achieve the effects described above.

TABLE 1

| Fuel | Air ° F. ° C. | Qxygen ° F. ° C. |
|---|---|---|
| CO | 1128609 | 1090588 |
| $CH_4$ | 999537 | 1033556 |
| $C_2H_6$ | 959515 | 943506 |
| $C_3H_6$ | 356458 | 793423 |
| $C_3H_8$ | 871466 | 874468 |
| n-$C_4H_{10}$ | 761405 | 542283 |
| iso-$C_4H_{10}$ | 864462 | 606319 |
| n-$C_5H_{12}$ | 496258 | 496258 |
| n-$C_6H_{14}$ | 433223 | 437225 |
| $H_2$ | 1062572 | 1040560 |

However, it should be noted that, while it has been demonstrated that the burner of the present invention has many advantages when used with a heated medium having a low melt temperature, this only indicates that its advantages are especially obvious when it is used with such a heated medium, but does not mean that the burner can only be used for such heated medium. The burner of the present invention may also be used for other heated medium, and will also have various advantages such as it not being easy to flame out, stable flame, etc.

By way of nonlimiting example, the mixing chamber may be designed such that the volume of the mixing chamber is no more than 500 ml, preferably 5-50 ml. Preferably, the length of the mixing chamber 3 in the flow direction of the fluid mixture is 0.5-20 times, preferably 1-5 times, the equivalent inner diameter of the mixing chamber 3. Preferably, the sectional area of the mixing chamber 3 may be 20-90%, preferably 40-60%, of the sectional area of the outer contour of the nozzle 4.

As an example of the design of the mixing chamber of the burner, when the submerged burner of the present invention is used to heat metals or alloys with a low melting point, for example, zinc (with the melting point of 419 degrees), lead (with the melting point of 327 degrees) or aluminium (with the melting point of 660 degrees), for a burner with a power range of 10 KW-1 MW, the volume of the mixing chamber is 5-200 ml, and the length of the mixing chamber 3 in the flow direction of the fluid mixture is 0.5-10 times the equivalent inner diameter of the mixing chamber 3.

As another example of the design of the mixing chamber of the burner, when the submerged burner of the present invention is used for heating water, etc., for a burner with a power range of 5 KW-0.5 MW, the volume of the mixing chamber is 5-150 ml, and the length of the mixing chamber 3 in the flow direction of the fluid mixture is 1-5 times the equivalent inner diameter of the mixing chamber 3.

By limiting the dimensions and parameters of the mixing chamber in the above examples, the first fluid and the second fluid can be vigorously mixed and form a turbulent flow in the mixing chamber of a limited space, and thus the local flow rate of the local stream of the fluid mixture will be smaller than the propagation speed of the flame produced by the combustion of the fluid mixture, thereby retaining the flame in the mixing chamber 3 (which may be regarded as the flame "burning back" into the mixing chamber 3). The flame residing in the mixing chamber makes it difficult for the flame in the burner to extinguish.

Further, it has been found in research and practice that the degree of mixing of the fuel and the oxidant plays a crucial role in the speed of combustion and the stability of the flame. For burners without premixing of the fuel and the oxidant, the combustion speed is limited by the speed of the instant mixing of the fuel and the oxidant outside the burner, and the combustion flame is unstable due to insufficiently even mixing. However, a burner with premixing has the problem of the risk of explosion caused by the premixed fluid. In the above-mentioned examples of the present invention, the advantages and disadvantages of premixing are balanced by the design of a mixing chamber. With the mixing chamber 3, the fuel and the oxidant are premixed in the mixing chamber 3 before being ejected from the burner. Premixing of the fuel and the oxidant results in faster combustion and a more stably burning flame. At the same time, the dimension design of the mixing chamber 3 limits its space to a certain size, thus preventing the accumulation of excess fluid mixture and the resulting risk of explosion.

In the examples of the present invention, the fuel may be hydrogen. Hydrogen has many advantages as a clean energy source, but it has been found in practice and research that the hydrogen flame is not bright when it is used as a fuel, the emissivity is low, and there is a problem of low heat transfer efficiency in flame radiation heating. In a submerged burner, thanks to the characteristics of direct contact heat conduction and convection in submerged combustion, the heat of the hydrogen flame can be fully transferred to the heated medium, and thus the heat of the hydrogen combustion can be better utilized. The use of hydrogen as the fuel for submerged burners also has the advantage that water is the only product of its oxidative combustion, thereby reducing carbon dioxide emission from the combustion process. If the heated medium is water, since the product of hydrogen combustion is also water, it is mixed into the heated medium, and thus there is almost no exhaust, which makes exhaust treatment quite simple or unnecessary. However, one of the problems with using hydrogen in submerged burners is that the combustion reaction between hydrogen and an oxidant is fast, and therefore premixing with it is relatively difficult and the risk of explosion is high. By contrast, in the burner of the above examples of the present invention, since the fuel and the oxidant are mixed in the mixing chamber 3, whose space is limited to a certain range by the dimension design, the accumulation of the mixed gas is prevented, and the risk of explosion easily caused by premixing hydrogen and the oxidant is lowered. Therefore, while overcoming the shortcomings of hydrogen as a fuel, it can not only achieve effective premixing to ensure a stable and continuous flame, but also prevent the risk of explosion. Thus, the burner having the exemplary structure of the present invention described above is particularly suitable for hydrogen as the fuel, and has excellent combustion performance when hydrogen is used as the fuel.

As shown in FIGS. 1 to 10, the burner comprises a first fluid guide 1, a second fluid guide 2 and a nozzle 4, and at least one first passage 114 is formed in the first fluid guide 1; at least one second passage 213 is formed in the second fluid guide 2; the mixing chamber 3 is formed between the first fluid guide 1 and/or the second fluid guide 2 on the one hand and the nozzle 4 on the other. Further, in the first and the second embodiments shown in FIGS. 1 to 5 and the third and the fourth embodiments shown in FIGS. 10 and 11, a through hole 113 passing through a first end surface 115 of the first fluid guide and a second end surface 116 in the mixing chamber 3 is formed in the first fluid guide 1, and the second fluid guide 2 is at least partially disposed in the through hole 113. The end face of the second fluid guide 2 may extend beyond the second end face 116 of the first fluid guide 1 (as shown in FIGS. 1 and 2), or its end face may be located in the through hole 113 (as shown in FIGS. 10 and 11), to define the mixing chamber 3 together with the nozzle 4 and the second end face 116 of the first fluid guide 1.

Further, in order to increase the extent of mixing of the fuel and the oxidant to provide a more stable flame, the present invention also provides a structure, wherein at the least one of the first passages 114 in the first fluid guide 1 is configured to cause the first fluid to produce a rotational flow in a first rotation direction, or it is also possible to adopt a structure in which the at least one second passage 213 is configured to cause the second fluid to produce a rotational flow in a second rotation direction. Or, a combination of the two may be used, in which case, preferably the first rotation direction is opposite to the second rotation direction. Using any of the above mixing methods can enhance the premixing degree of the fuel and the oxidant, and improve the stability of the flame produced by combustion. The premixed fluid mixture is rapidly mixed and rapidly combusted in the mixing chamber of the burner. As mentioned above, the first fluid and the second fluid can be rotated at the same time but in opposite directions, and the fluids in the two opposite directions collide and mix in the mixing chamber 3, to achieve a better mixing result.

Figure 5:
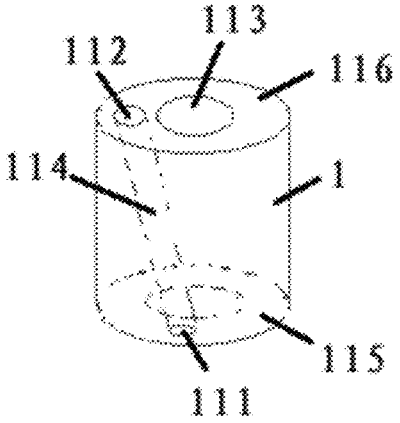
FIG. 5 is a schematic space view of an exemplary first fluid guide, wherein the dotted line schematically shows one first passage.
Figure 6:
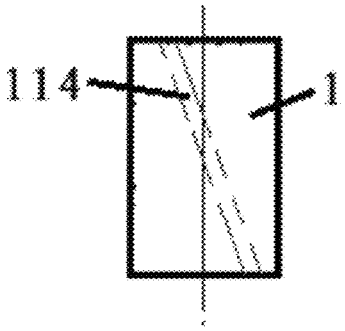
FIG. 6 is a front view of the first fluid guide in FIG. 5, wherein the dotted line schematically shows the direction of one first passage.
Figure 7:
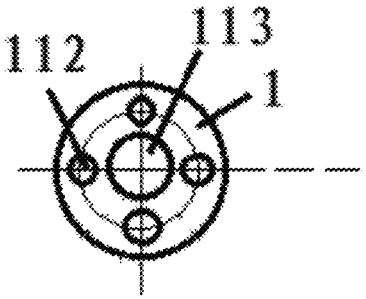
FIG. 7 is a top view of the first fluid guide in FIG. 5.
Figure 8:
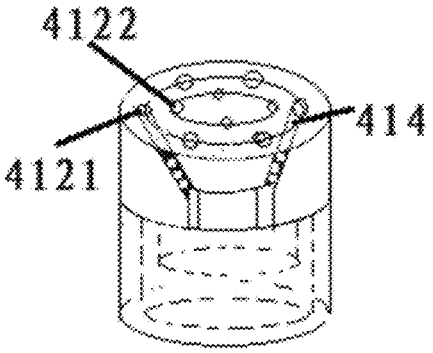
FIG. 8 is a schematic space view of an exemplary nozzle.

As an example, FIGS. 1 to 3 and 5 to 7 show a first fluid guide 1, which is in a structure that causes the first fluid to produce a rotational flow in the first rotation direction. With reference to FIG. 5 in particular, the at least one first passage 114 is a plurality of first passages (four in the figure), wherein the plurality of first passages 114 extend from the inlet 111 on the first end face 115 of the first fluid guide 1 to the outlet 112 on the second end face 116 of the first fluid guide 1 (it can be seen from the figure that it is in a direction not parallel to the axis of the fluid guide 1 and not in the same plane as the axis), wherein the outlet of each of the first passages 114 is located at a different position from its inlet in the circumferential direction, so that the first fluid flows out obliquely with respect to the second end face 116, and the first fluid from the plurality of first passages forms a rotational flow as a whole in the first rotation direction (clockwise direction, at the viewing angle from the left toward the first fluid guide 1 and the second fluid guide 2 in FIGS. 2 and 3 and at the viewing angle from the top toward the first fluid guide 1 in FIG. 5) in the mixing chamber 3.

In the first and the second embodiments shown in FIGS. 1 to 3 and the third and the fourth embodiments shown in FIGS. 10 and 11, a second passage 213 is formed in the second fluid guide 2, wherein a helical groove 2131 in a helical direction of the second rotation direction is formed in at least a part of it, and the rotational flow produced thereby is in the counter-clockwise direction (at the viewing angle from the left toward the first fluid guide 1 and the second fluid guide 2 in FIGS. 2 and 3). The two rotational flows in the opposite directions collide, thereby achieving more sufficient mixing.

Those skilled in the art can understand that, although one second passage 213 is shown in the above example and the accompanying drawings to realize the rotational flow of the second fluid, other methods may also be used, for example, providing a plurality of second passages to realize the rotational flow of the second fluid. It can also be understood that at least a part of the at least one first passage 114 may also be formed with a helical groove in the helical direction of that of the first rotational flow. In addition, different methods for forming rotational flows, for example, by inclining the flow path and by forming a helical groove, may be used in combination to achieve a more sufficient mixing result.

As an example, the third embodiment in FIG. 10 shows another structure of the first fluid guide 1 that causes the first fluid to produce a rotational flow in the first rotation direction. The at least one first passage 114 is a plurality of first passages, each first passage 114 comprises a first part 1141 extending parallel to the axis of the burner from the inlet 111 of the first passage 114 and a second part 1142 extending obliquely relatively to the axial direction of the burner from the first part 1141 to the outlet 112 of the first passage 114, wherein an extension of the second part (for example, an extension of its centreline) intersects the axis of the burner. To achieve a rotational flow of the first fluid, a helical groove in the helical direction of the first rotation direction may be formed in the first part 1141 and/or the second part 1142.

Those skilled in the art can understand that a mixing method similar to that of the first passage 114 schematically shown in FIGS. 1 to 3 and 5 to 7 may also be used for the second part 1142, i.e., the outlet of the second part is located at a different position in the circumferential direction relative to its inlet, so that flows of the first fluid from the plurality of first passages form a rotational flow in the first rotation direction as a whole in the mixing chamber.

A plurality of outlets 112 of the first passage 114 may be evenly distributed on the same circumference, and a plurality of inlets 111 of a plurality of first passages 114 may also be evenly distributed on the same circumference.

As shown in FIGS. 1 to 3, 8 and 9, there may be a plurality of through passages 41 in the nozzle 4, and preferably, each through passage may extend gradually away from the axis of the nozzle from its inlet 411 to its outlets 4121 and 4122. By providing a plurality of through passages in this way, the area of the flame is increased in general, and the equivalent diameter/aperture of the outlet of each through passage may be designed to be relatively small, thereby making the flame shorter and thus more stable and not easy to extinguish.

Exemplarily, the plurality of through passages 41 may include inner passages 413 and outer passages 414, wherein each outer outlet 4121 of the outer passages 414 is located outside each inner outlet 4122 of the inner passages 413 in the radial direction of the nozzle. In this structure, since the inner passages are closer to the outlets of the inner fuel passages (i.e., the second passages 213), the fuel content is higher than that in the outer passages, so that the flame in the inner passages is less likely to extinguish, and ignition can be carried out faster after the flame extinguishes.

Preferably, the aperture of the inner outlets 4122 is smaller than that of the outer outlets 4121. For the inner outlet 4122 with a small aperture, the flame is shorter, and the fuel content is higher, so that it is not easy to extinguish, and it is convenient to retain the combustion source of the burner; in addition, the momentum and impact force of the fluid mixture flowing out are smaller, so that it is easier to ignite after the flame extinguishes.

Preferably, the outer outlets 4121 are evenly distributed on the same circumference. The inner outlets 4122 may also be evenly distributed on the same circumference. Thus, the flame intensity is made more uniform in general. The inner outlets 4122 are spaced apart from the outer outlets 4121 in the circumferential direction. Preferably, each inner outlet 4122 is located in the middle between two outer outlets 4121 adjacent to it in the circumferential direction. All of the above methods can achieve a more even distribution of the fluid mixture to form a more uniform flame intensity.

For the outer outlets 4121 and the inner outlets 4122 of the through passages, in order to prevent blocking of the through passages caused by the infiltration of the heated medium or its melt into the through passages from these outlets, the equivalent diameter of each outlet may be designed in the range of 0.3 mm-10 mm, preferably 0.8 mm-6 mm, and more preferably 1 mm-5 mm. The equivalent diameter is small enough to prevent the heated medium or its melt from infiltrating back into the through passages, while allowing the flow of the fluid mixture.

Preferably, the flow rate of the first fluid at the outlet 112 of the first passage and the flow rate of the second fluid at the outlet 212 of the second passage may both be made greater than the flow rate of the mixture at the outlet 412 of the through passage 41; preferably, the flow rate of the second fluid at the outlet 212 of the second passage is greater than that of the first fluid at the outlet 412 of the first passage. The mixing result will be better when the first fluid and the second fluid are ejected at higher speeds at the outlets of the first passage 21 and the second passage 31. The dimensions of the outlets of the through passages described above, the higher flow rates of the first fluid, the second fluid and the resulting mixture, and the pressure of the fluid mixture in the mixing passages independently or in combination ensure that the outlets of the through passages cannot easily be blocked, thus preventing damage to the burner nozzle and the burner.

Further, in one example of the present invention, the outlets of the through passages may be constructed such that the propagation speed of the flame is smaller than the flow rate of the mixture at the outlets 412 of the through passages 41. This structure is beneficial for the flame to be sprayed into the heated medium from the outlets 412 of the through passages. Thus, the flame extends from the mixing chamber 3 into the heated medium outside the outlets 412 of the through passages of the burner for heat transfer, and at the same time, the flame can be retained in the mixing chamber 3 to prevent flame-out.

As shown in FIG. 1, the burner may further comprise an igniter 7 extending into the mixing chamber 3. Preferably, the burner of the present invention may further comprise an intelligent ignition system, wherein the ignition system comprises a sensor 11 and a controller used for monitoring the flame status in the burner, and the controller is configured to control the igniter to fire when the sensor senses that the flame in the burner is extinguished. The sensor 11 comprises, for example, a monitor for monitoring the flame in the mixing chamber, such as an ultraviolet monitor, or a thermocouple for measuring the temperature in the burner. As shown in FIG. 1, the sensor 11 may be mounted to be aligned with the delivery pipeline of the second fluid, and the radiation of the ultraviolet monitor, for example, passes through the delivery pipeline 211 of the second fluid and the second passage 213 to detect a flame in the mixing chamber 3. A thermocouple may also be provided on the burner to measure the temperature of the burner. When the temperature of the burner drops to a certain threshold, it indicates that the burner has flamed out. An ultraviolet monitor and a thermocouple may also be used in combination. With this intelligent ignition system, the flame and/or temperature of the burner can be monitored in real time, thus reducing damages caused by accidental flame-out.

In the first and the second embodiments shown in FIGS. 1 to 3, the burner further comprises an independent main body 5, to which the nozzle 4 is connected, wherein the nozzle 4, the first fluid guide 1 and the second fluid guide 2 are separate components. With this exemplary structure, individual replacement of the nozzle 4, the first fluid guide 1 and the second fluid guide 2 is made possible, thereby lowering the maintenance costs of the burner.

Figure 9:
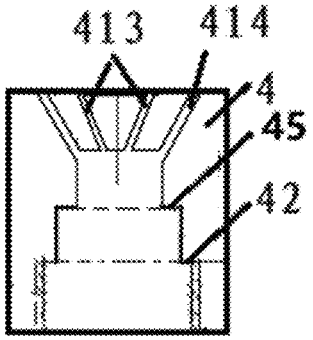
FIG. 9 is a schematic profile view of the nozzle in FIG. 8.

In the burner of the second embodiment shown in FIGS. 3 and 9, a first step portion 45 and a second step portion 42 are formed in the nozzle 4, wherein the end face 116 of the first fluid guide 1 abuts the first step portion 45, and the main body 5 comprises a connecting portion that abuts the second step portion 42.

In the burner of the third embodiment shown in FIG. 10, the nozzle 4 and the main body may be formed as an integral piece. In the burner of the fourth embodiment shown in FIG. 11, the nozzle 4 and the main body are also formed as an integral piece.

As described above, in the submerged burner of the present invention, the nozzle can be cooled without the need for an additional cooling device when the temperature of the melt of the heated medium is lower than the maximum temperature that the nozzle material can withstand. However, the burner of the present invention may also be used for other heated medium, and will also have various advantages such as not being easy to flame out, stable flame, etc. Therefore, in the burner of the present invention, an additional cooling device may also be provided for other heated medium, or for an enhanced cooling effect when the melt of the heated medium cools the burner. As shown in the fourth embodiment of FIG. 11, a first cooling medium channel 44 may be integrated in the integral piece formed by the nozzle 4 and the main body of the burner, preferably, as shown in FIG. 11. The first cooling medium channel 44 extends to the through passage 41 of the nozzle 4 to achieve better cooling of the burner nozzle.

Figure 12:
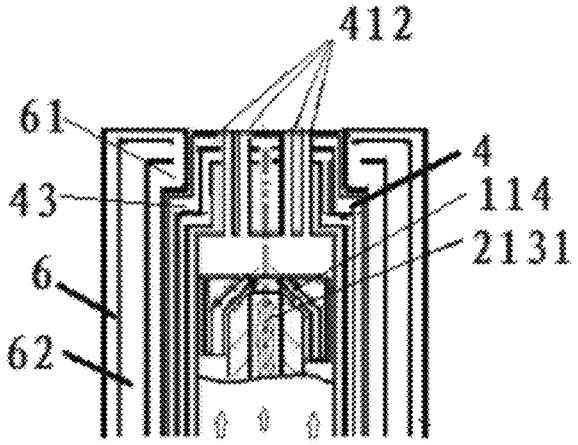
FIG. 12 is a schematic diagram of the burner assembly of an exemplary embodiment of the present invention.

The present invention may also provide a burner assembly, as schematically shown in FIG. 12. The assembly may comprise a burner of the foregoing various examples and a cooling jacket 6 disposed outside the burner, and a second cooling medium channel 62 is formed in the cooling jacket. Exemplarily, several openings (for example, 4 to 8 openings) may be made in the refractory bricks of the furnace, and a separate cooling jacket may be provided in each opening. Each burner may be inserted into one cooling jacket, forming a burner group as a whole. A burner group may be sized based on the heating position and the heating power needs.

Figure 13:
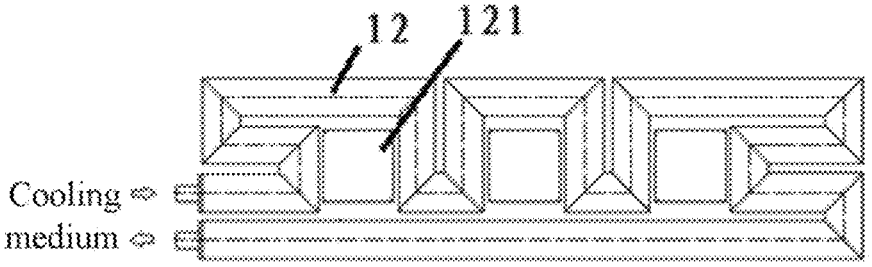
FIG. 13 is a schematic diagram of the burner module of an exemplary embodiment of the present invention.
Figure 13A:
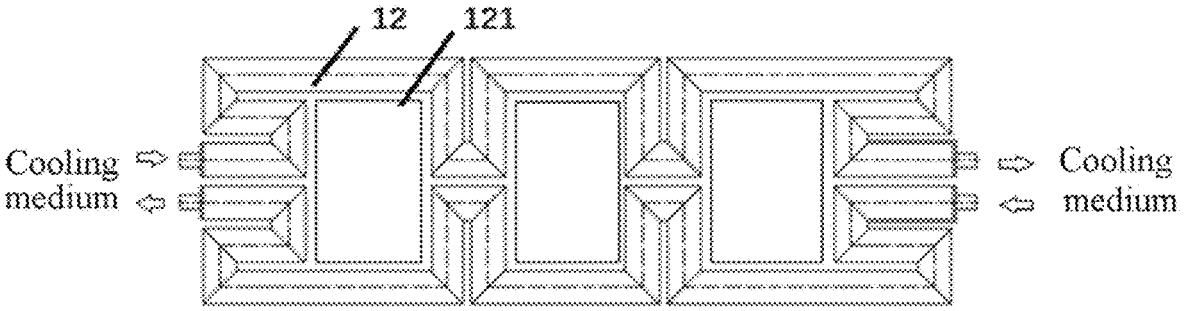
FIG. 13A is a schematic diagram of the burner module of another exemplary embodiment of the present invention.
Figure 14:
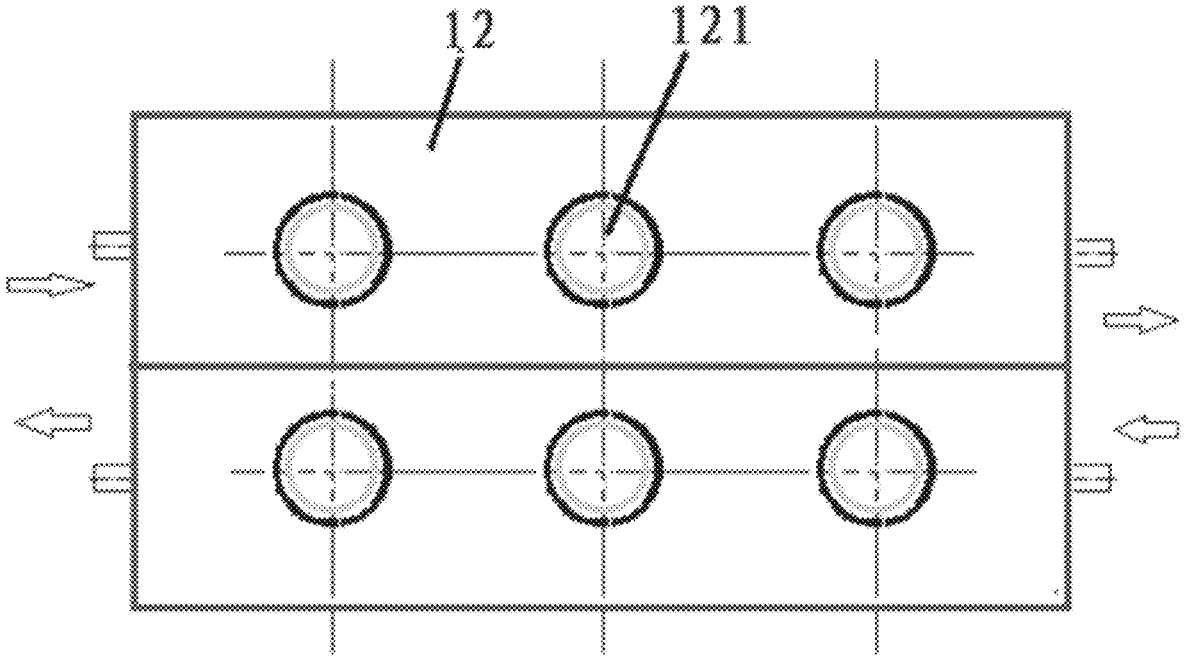
FIG. 14 is a schematic diagram of the burner module of yet another exemplary embodiment of the present invention.

In order to save costs and simplify the installation process, the present invention also provides a burner module, which comprises the burners in the above examples and a common cooling block 12, as shown in FIG. 13, FIG. 13A or FIG. 14. A plurality of installation spaces 121 are defined in the common cooling block 12 (for example, a cooling plate), wherein each burner is installed in a corresponding one of the installation spaces and is cooled therein. In this approach, the costs are lowered and installation is simplified by eliminating the need to install separate cooling jackets for each burner. Those skilled in the art can understand that, in order to achieve a better cooling effect, the burner assembly comprising the cooling jacket 6 may also be arranged in the installation spaces 121 for doubled cooling of the burner. In the embodiment shown in FIG. 13A, the common cooling block 12 is composed of a first part and a second part that are independent of each other, the first part and the second part together define the installation spaces, and preferably, as shown in the figure, the flow direction of the cooling medium in the first part is opposite to that of the cooling medium in the second part. The structure in FIG. 13A provides adequate cooling and facilitates placement of the burner or burner assembly. When the size of the burner is slightly different from that of the installation space, the relative position between the first part and the second part may be adjusted to adapt to its size for the best fitting.

Figure 15:
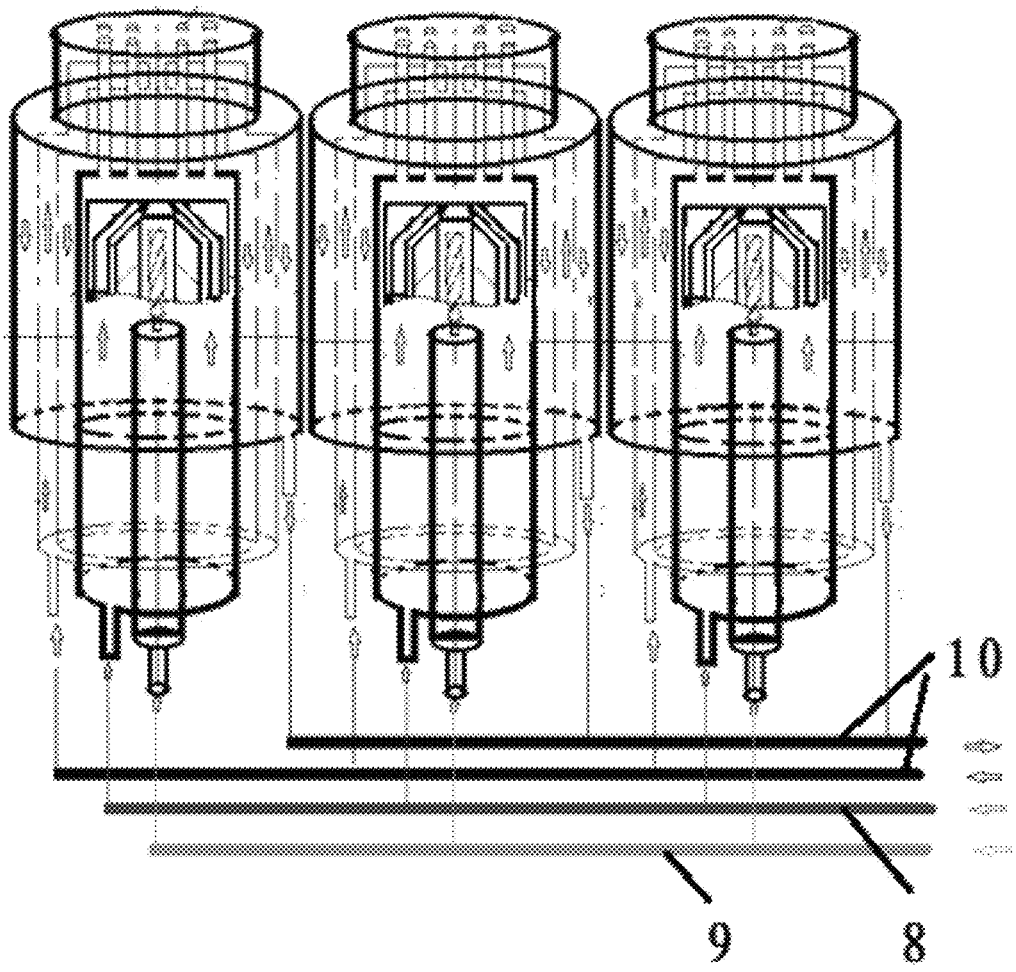
FIG. 15 is a schematic diagram of the burner combination of an exemplary embodiment of the present invention.

The present invention also provides another burner module, which comprises a plurality of burners of the above examples, a first fluid supply pipeline 8 supplying each burner with the first fluid, and a second fluid supply pipeline 9 capable of supplying each burner with the second fluid, as shown in FIG. 15. Equipment costs can be lowered by using a plurality of burners together to form a burner combination or module and centrally supplying the first fluid and the second fluid to these burners (for example, 4 to 8 burners). Exemplarily, a supply control system for the first fluid and the second fluid may be provided separately for each burner, which comprises, for example, a valve, and a display for separately displaying parameters such as the flow rate, temperature or pressure may also be provided on each burner, so that the supply to each burner can be adjusted as required. Those skilled in the art can understand that the above-mentioned burner assemblies provided with cooling jackets may also be supplied in a centralized manner, i.e., another burner module can be provided, which comprises a plurality of the burner assemblies described above, a first fluid supply pipeline 8 capable of supplying the first fluid to each burner assembly, a second fluid supply pipeline 9 capable of supplying the second fluid to each burner assembly, and a cooling medium loop 10 capable of supplying the cooling medium to each burner assembly.

The present invention also provides a heating device, a medium to be heated is accommodated in the heating device, and one or more of the burner, burner assembly and burner module described above may be provided in the heating device. The burner, or burner assembly, or burner module may be positioned in the bottom or side wall or top wall of the furnace. The nozzle of a submerged burner is immersed in the heated medium. The heating device can achieve various power ranges as required by flexibly combining the burners.

Although some embodiments of the general concept of the present invention have been shown and described, those ordinarily skilled in the art will understand that changes can be made to these embodiments without departing from the principle and motivation of the general concept of the present invention. The scope of the present invention is defined by the claims and their equivalents.

What is claimed is:

1. A burner, comprising:

at least one first passage, with a first inlet of each of the first passages fluidly connected to a supply port of a first fluid;

at least one second passage, with a second inlet of each of the second passages fluidly connected to a supply port of a second fluid; and a mixing chamber, which is respectively fluidly connected to a first outlet of the first passage and a second outlet of the second passage, wherein the first fluid and the second fluid are mixed in the mixing chamber to form a fluid mixture;

wherein the mixing chamber has a sectional area the burner comprising a nozzle, and at least one through passage fluidly connected to the mixing chamber is formed in the nozzle, wherein the at least one through passage has a sectional area, configured such that that the fluid mixture flows out from the at least one through passage, wherein the sum of the sectional areas of the at least one through passage is smaller than the sectional area of the mixing chamber, wherein the at least one first passage is configured to cause the first fluid to produce rotational flow in a first rotation direction; and/or the at least one second passage is configured to cause the second fluid to produce rotational flow in a second rotation direction, wherein the at least one first passage is a plurality of first passages, wherein the outlet of each of the first passage is located at a different position in the circumferential direction relative to the inlet thereof, wherein flows of the first fluid from the plurality of first passages form a rotational flow in the first rotation direction as a whole in the mixing chamber.

2. The burner according to claim 1, wherein the sum of the sectional areas of all the through passages is 5-90% of the sectional area of the mixing chamber.

3. The burner according to claim 1, wherein none of the through passages in the nozzle is on the same axis as the second passage; or the at least one through passage includes a through passage on the same axis as the second passage, wherein the equivalent diameter of the through passage on the same axis as the second passage is smaller than 50% of the equivalent diameter of the outlet of the second passage.

4. The burner according to claim 1, wherein a plurality of through passages are provided in the nozzle, and the through passages include inner passages and outer passages, wherein an outer outlet of each outer passage is located outside an inner outlet of each inner passage in the radial direction of the nozzle.

5. The burner according to claim 4, wherein the through passages extend in a direction gradually away from an axis of the nozzle from the inlets to the outlets.

6. The burner according to claim 4, wherein the outer outlets are evenly distributed on one circumference, and/or the inner outlets are evenly distributed on one circumference.

7. The burner according to claim 6, wherein the inner outlets are spaced apart from the outer outlets in the circumferential direction.

8. The burner according to claim 1, wherein the outlet of the at least one through passage is configured such that a propagation speed of a flame is smaller than a flow rate of a mixture at the outlet of the through passage.

9. The burner according to claim 1, wherein the flow rate of the first fluid at the outlet of the first passage and the flow rate of the second fluid at the outlet of the second passage are both greater than the flow rate of the mixture at the outlet of the through passage.

10. The burner according to claim 1, wherein a helical groove with the helical direction being the first rotation direction is formed in at least a part of the at least one first passage, and/or a helical groove with the helical direction being the second rotation direction is formed in at least a part of the at least one second passage.

11. A burner, comprising:

at least one first passage, with a first inlet of each of the first passages fluidly connected to a supply port of a first fluid;

at least one second passage, with a second inlet of each of the second passages fluidly connected to a supply port of a second fluid; and a mixing chamber, which is respectively fluidly connected to a first outlet of the first passage and a second outlet of the second passage, wherein the first fluid and the second fluid are mixed in the mixing chamber to form a fluid mixture;

wherein the mixing chamber has a sectional area the burner comprising a nozzle, and at least one through passage fluidly connected to the mixing chamber is formed in the nozzle, wherein the at least one through passage has a sectional area, configured such that that the fluid mixture flows out from the at least one through passage, wherein the sum of the sectional areas of the at least one through passage is smaller than the sectional area of the mixing chamber, wherein the at least one first passage is configured to cause the first fluid to produce rotational flow in a first rotation direction; and/or the at least one second passage is configured to cause the second fluid to produce rotational flow in a second rotation direction, wherein the at least one first passage is a plurality of first passages, and each of the first passages comprises:

a first part, extending parallel to an axis of the burner from the inlet of the first passage; and a second part, an outlet of which is located at a different position in the circumferential direction relative to an inlet thereof, so that flows of the first fluid from the plurality of first passages form a rotational flow in the first rotation direction as a whole in the mixing chamber.

12. A burner, comprising:

at least one first passage, with a first inlet of each of the first passages fluidly connected to a supply port of a first fluid;

at least one second passage, with a second inlet of each of the second passages fluidly connected to a supply port of a second fluid; and a mixing chamber, which is respectively fluidly connected to a first outlet of the first passage and a second outlet of the second passage, wherein the first fluid and the second fluid are mixed in the mixing chamber to form a fluid mixture;

wherein the mixing chamber has a sectional area the burner comprising a nozzle, and at least one through passage fluidly connected to the mixing chamber is formed in the nozzle, wherein the at least one through passage has a sectional area, configured such that that the fluid mixture flows out from the at least one through passage, wherein the sum of the sectional areas of the at least one through passage is smaller than the sectional area of the mixing chamber, wherein the at least one first passage is configured to cause the first fluid to produce rotational flow in a first rotation direction; and/or the at least one second passage is configured to cause the second fluid to produce rotational flow in a second rotation direction, wherein the at least one first passage is a plurality of first passages, and each of the first passages comprises:

a first part, extending parallel to an axis of the burner from the inlet of the first passage; and a second part, extending obliquely toward an axis of the burner from the first part to the outlet of the first passage.

13. The burner according to claim 1, wherein between the first fluid and the second fluid, one is an oxidant, and the other is a fuel.

* * * * *